US008662149B1

(12) United States Patent
Bernert, Jr. et al.

(10) Patent No.: US 8,662,149 B1
(45) Date of Patent: Mar. 4, 2014

(54) FROST FREE CRYOGENIC AMBIENT AIR VAPORIZER

(71) Applicants: Robert E. Bernert, Jr., Dartmouth, MA (US); Robert E. Bernert, Sr., Dartmouth, MA (US)

(72) Inventors: Robert E. Bernert, Jr., Dartmouth, MA (US); Robert E. Bernert, Sr., Dartmouth, MA (US)

( * ) Notice: Subject to any disclaimer, the term of this patent is extended or adjusted under 35 U.S.C. 154(b) by 0 days.

(21) Appl. No.: 13/694,395

(22) Filed: Nov. 28, 2012

(51) Int. Cl.
*F28F 13/00* (2006.01)

(52) U.S. Cl.
USPC ..... 165/135; 165/136; 165/134.1; 165/180

(58) Field of Classification Search
USPC ..... 165/135, 134.1, 136, 177, 180, 905, 165/DIG. 183, DIG. 513, DIG. 533
See application file for complete search history.

(56) References Cited

U.S. PATENT DOCUMENTS

| | | | | |
|---|---|---|---|---|
| 2,322,341 | A | 6/1943 | Booth | |
| 3,124,940 | A | 3/1964 | Guelton | |
| 3,293,871 | A | 12/1966 | Tyree | |
| 3,735,465 | A | 5/1973 | Tibbetts | |
| 4,399,660 | A | 8/1983 | Vogler | |
| 4,487,256 | A | 12/1984 | Lutjens et al. | |
| 5,341,769 | A | 8/1994 | Ueno | |
| 5,390,500 | A | 2/1995 | White | |
| 7,185,698 | B1 * | 3/2007 | Bernert et al. | 165/135 |
| 8,069,678 | B1 | 12/2011 | Bernert | |
| 2003/0159800 | A1 | 8/2003 | Nierenberg | |
| 2007/0214805 | A1 | 9/2007 | MacMillan | |
| 2007/0214806 | A1 | 9/2007 | Faka | |
| 2007/0214807 | A1 | 9/2007 | Faka | |
| 2008/0250795 | A1 | 10/2008 | Katdare | |
| 2009/0126372 | A1 | 5/2009 | Faka | |
| 2010/0043452 | A1 | 2/2010 | Baudat | |
| 2010/0101240 | A1 | 4/2010 | Mak | |
| 2010/0205979 | A1 | 8/2010 | Gentry | |
| 2011/0030391 | A1 | 2/2011 | Faka | |

OTHER PUBLICATIONS

Bernert the Limiting Volume Required for Cryogenic Ambient Air Vaporizers Due to Frost Formation Aiche Spring Meeting May 2000 Atlanta Paper 586 pp. 188-196.

Bernert Further Remarks on the Limitations of Ambient Vaporizers in Continuous Operation Proc. of the Twelfth International Cryogenic Engineering Conference, Southampton, U.K. Jul. 1988 pp. 351-354.

* cited by examiner

*Primary Examiner* — Teresa Walberg
(74) *Attorney, Agent, or Firm* — Robert J Doherty

(57) ABSTRACT

A cryogenic fluid vaporizer using ambient air comprising a conduit through which the fluid is passed having an outer finned tubular sleeve which includes a thermal insulation barrier between the conduit and the outer finned tubular sleeve. A fan may be included to provide an increased rate of heat transfer from the air to the outer surface of the fins of the tubular sleeve. The combination of the externally finned area and the insulating thermal barrier prevents the information of ice or frost on the exterior surface of the fins during the transfer of heat from the ambient air to the cryogenic fluid providing a frost-free cryogenic ambient air vaporizer for continuous operation.

10 Claims, 3 Drawing Sheets

FROST FREE CRYOGENIC AMBIENT AIR VAPORIZER

FIELD OF THE INVENTION

The present invention relates to a method and apparatus for the continuous regasification of cryogenic fluids and liquefied natural gas ("LNG") which relies only on ambient air as the heat source. The subject ambient air exchangers continuously heat the cryogenic fluid directly through the heat exchange elements without using an intermediate fluid and without forming ice or frost on the outer surface of the finned tube heat exchange elements.

BACKGROUND OF THE INVENTION

The convenience of transporting and storing industrial gases such as oxygen and nitrogen including LNG is well established. At the use site, the liquefied gas is stored in liquid form at a cryogenic temperature in the range of about −100° F. to −320° F. The liquefied gas is then vaporized and superheated to near ambient temperatures before use. Various heat sources are used to supply the heat for vaporization such as waste process heat, seawater, fired heaters and ambient air. For example, in the case of LNG which is used as a fuel gas, about 2% of the combustion heat of the fuel gas is required for vaporization of the LNG and, for this reason, ambient atmospheric air is a desirable heat source. In Patent Publication U.S. 2010/0043452 A1, Baudat uses water or other intermediate heat transfer fluid loop in which the water or heat transfer fluid is heated as the water is recirculated through an air tower. When the air is too cold, supplemental heat is provided to the process.

The disadvantage of using an intermediate heat transfer fluid loop in any heat transfer process, such as the water loop of Baudat, is that there is a temperature difference loss within each separate fluid (water) loop. These temperature differences are additive that reduce the useful range of the ambient air temperature which may be utilized economically in a process such as Baudat, notwithstanding the added complexity and cost of the apparatus.

In Patent Publication 2007/0214805 A1, Armstrong et al describes a shipboard LNG vaporizer using ambient air and an intermediate heat transfer fluid together with redundant vaporizers to allow for defrost cycles.

In Patent Publication 2010/02505979 A1, Gentry et al describes a heated fluid LNG regasification apparatus.

In Patent Publication 2003/0159800 A1, Nierenberg uses seawater as the heat source for LNG regasification.

In Patent Publication 2007/0214806 A1, Faka continuously regasifies LNG using ambient air together with an intermediate fluid heat transfer loop auxiliary heater wherein the ambient air heater is subjected to a defrost cycle.

In Patent Publication 2011/0030391 A1, Faka employs a mechanical device to remove frost from his continuous ambient air vaporizer and additionally adds an intermediate heat transfer fluid loop.

In Patent Publication 2010/0101240 A1, Mak describes a forced ambient air vaporizer wherein the moist air is dehydrated for subsequent use within his multi-chambered vaporizer system. A temperature control scheme maintains Mak's air above 32° F.; however, no instructions of fin surface temperature where ice may form is discussed in Mak's complicated and costly apparatus.

In Patent Publication 2009/0126372 A1, Faka describes a forced ambient air continuous regasifier that employs a source of heat to intermittently defrost his vaporizer.

Vogler, Jr. et al in U.S. Pat. No. 4,399,660 (1983) describe an ambient air vaporizer with a particularly wide space between their finned tube vaporizer elements to allow for ice growth therein. A steady state frost/ice layer is claimed.

At the AIChE May 2000 spring meeting, Paper #58e, PP 188-196, Bernert further discusses this ice growth problem.

In U.S. Pat. No. 3,293,871 (1966), Tyree, Jr. attaches fins to his vaporizer tubes, said fins being in thermal contact with the tube by suitable means such as soldering. A fan is used to provide a constant stream of ambient air across the fins. Tyree states that although he has ice growth, "it is highly unlikely" for the heat transfer surface to become iced over thus providing defrost means.

In U.S. Pat. No. 5,390,500 (1995), White et al describes various means to manage the ice growth common to ambient air vaporizers. Various concentric tubular assemblies are postulated which rely on flowing or stagnant gas layers combined with internally finned elements partially filled with various filler materials that are in contact with the fluid to be vaporized. It is well known that apparatus used for certain cryogenic liquefied gases such as liquid oxygen should avoid direct contact with such materials. A multiple tube combination is described to complete the apparatus.

In U.S. Pat. No. 3,124,940 (1964), Guelton describes a mechanical defrosting device for a Fan-Ambient air vaporizer thus illustrating an early awareness of the frost/ice formation problem associated with ambient air cryogenic vaporizers.

Booth, in U.S. Pat. No. 2,322,341 (1943), describes an extruded axially-finned aluminum heat exchange element for refrigerants to be evaporated. Such elements are presently used in many different embodiments in cryogenic vaporizers.

In U.S. Pat. No. 3,735,465 (1973), Tibbetts et al describes a finned tube assembly for use in cryogenic vaporizers wherein the extended surface portions are clamped or locked directly onto an elongated tubular member such that "complete contact" is made between the surface to achieve "optimum heat transfer characteristics" and thus "minimizing the thermal contact resistance between the tubing and the hub". When assembled into a multi-element vaporizer, a fan may be employed. Conversely rather than "minimizing the thermal resistance" of Tibbetts et al, the invention of the present application, as described and claimed, purposely introduces a particular thermal resistance to heat transfer to achieve improved performance.

Similarly to Tibbetts et al, Lutjens et al in U.S. Pat. No. 4,487,256 (1984) describes a clamped fin tube assembly for cryogenic ambient air vaporizers which describes less frosting in the hub area and further that the tube is in intimate contact with the outer sleeve halves to form a common forced ambient air cryogenic vaporizer heat exchange element. Mentioned also is the use of a "thin coating (0.001 inch-0.100 inch) of fluorocarbon or Teflon applied to the" internal cylindrical surface of the hub such that the layer is so thin that even only a temperature drop of 1° or (so) has been encountered across this film, which statement indicates a failure of the prior art to appreciate the nature of the frost growth problem in these vaporizers.

In Patent Application 2007/0214807 A1, Faka employs ambient air with an air heater to prevent icing in similar fashion as Katare does in Patent Application 2007/0250795 A1. In U.S. Pat. No. 8,069,678 B1 (2011), Bernert describes an improved regasification ambient air heat exchange element employing a thermally conductive adhesive to bond the inner fluid tubular conduit to the outer finned hollow bore heat transfer element to improve heat transfer between the ambient air and the cryogenic fluid again, as in Tibbetts above, accepting ice growth as a given to be accommodated with alternate design features.

The reason why atmospheric vaporizers are not used more widely for continuous service is because ice and frost build up on the outside surfaces of the vaporizer that are exposed to the moist ambient air. Not only does the ice inhibit effective vaporizer capacity, the weight of the ice creates a structural problem as well as requiring greater space or larger sized units (for example, in Vogler, Jr. described above) to accomplish a given rate of regasification. Where continuous operation is required, either auxiliary heat or switching redundant modules have been shown in prior art to be necessary.

For the foregoing reasons, there remains a need for a process and apparatus for regasifying or vaporizing cryogenic fluids using only ambient air in direct contact with the cryogenic heat exchange elements which apparatus permits ice-free/frost-free continuous operation of cryogenic fluid vaporizers that use only ambient air as the heat source.

OBJECTS OF THE INVENTION

Accordingly, it is an object of this present invention to provide a cryogenic fluid vaporizer that uses only ambient atmospheric air as the heat source.

It is another object of this invention to provide a cryogenic fluid ambient atmospheric air vaporizer which operates continuously without requiring periodic shutdown for deicing and avoiding the drastic reduction in the operating efficiency characteristic of prior art atmospheric ambient air cryogenic fluid vaporizers.

It is yet another object of this present invention to provide a cryogenic fluid vaporizer using only ambient atmospheric air as the heat source without the use of intermediate heat transfer fluids which ambient air-heated vaporizer operates without frost or ice formation on the heat exchange surface that is in direct contact with the atmospheric ambient air.

Another object of the present invention is to provide a frost-free ambient air cryogenic fluid vaporizer that utilizes a forced air draft means or fan.

Other objects, features and advantages of the invention shall become apparent as the description thereof proceeds when considered in connection with the accompanying illustrative drawings.

SUMMARY OF THE INVENTION

The above and other objects which will be apparent to those skilled in the art are achieved by the present invention which comprises an apparatus for continuously vaporizing a cryogenic fluid by employing only heat absorbed from the ambient atmospheric air, the apparatus comprising a least one or more heat exchange vaporizer elements which are connected together to form an ambient air cryogenic fluid vaporizer. Each heat transfer element is comprised of a central or inner tube contained within an outer tube or central hub with external heat exchange fins. The central tube, which may be of a suitable metal for cryogenic temperature, such as austenitic stainless steel, aluminum, monel or copper, has an outside diameter of from about 0.25 inch to 1.0 inch and preferably about 0.5 inch and is of sufficient thickness to contain the requisite cryogenic fluid supply pressure. The outer tube or central hub with external heat exchange fins into which the central tube is fully inserted has an inside diameter greater than the outside diameter of the central tube such that a gap results between the central tube outer surface and the inside surface of the outer tube or central hub. This gap, which may vary between about 0.005 inch and 0.05 inch and preferably about 0.015 inch, is filled with a thermal barrier material suitable for exposure to cryogenic temperatures which material has a thermal conductivity sufficient to effectively form a thermal barrier to the flow of heat between the cryogenic fluid that flows thru the inner tube and the ambient air which, by either natural or forced draft, flows over and in direct contact with the outer surface of the outer tube having external fins. Preferably, the element is formed of extruded aluminum having a central tubular hub having an internal diameter of about 0.53 inch for the 0.5 inch outside diameter fluid tube described above, and eight to twenty external axial aluminum fins which extend radially outward about three to four inches from the outer tube central hub, said fins being about 0.055 inch to 0.07 inch thick. Such preferred heat exchange vaporizer element would have a surface area ratio of external finned surface area divided by internal liner tube inside surface area of between about 70 to 130, with an overall length varying between four and forty feet.

The thermal barrier material has a relatively low thermal conductivity in the range of between 0.02 BTU/(HR) (FT) (Deg F.) and 0.07 BTU/(HR) (FT) (Deg F.), preferably about 0.05 BTU/(HR) (FT) (Deg F.). The thermal barrier in combination with both the configuration of the heat exchange element providing the above said surface area ratio and the heat transfer characteristics of the other elements of the overall heat exchange process is sufficient to provide a temperature drop from the external ambient air to the internal cryogenic fluid such that the outer finned surface exposed to the air is maintained at or above about 32° F. (the freezing point of water) and thus little or no ice forms on the outer surface of the outer finned tube. Such temperature drop varies based on the temperature of the cryogenic fluid, the temperature of the surrounding ambient air and the heat transfer coefficients of the overall process, for example, in the case of liquid nitrogen, the temperature drop is about 330° F. or in the case of the liquefied natural gas (LNG), the temperature drop is about 270° F.

BRIEF DESCRIPTION OF THE DRAWINGS

In the drawings which illustrate the best mode presently contemplated for carrying out the present invention:

FIG. 1A is an enlarged detailed view of the circled portion of FIG. 1;

DETAILED DESCRIPTION OF THE INVENTION

Figure 1:
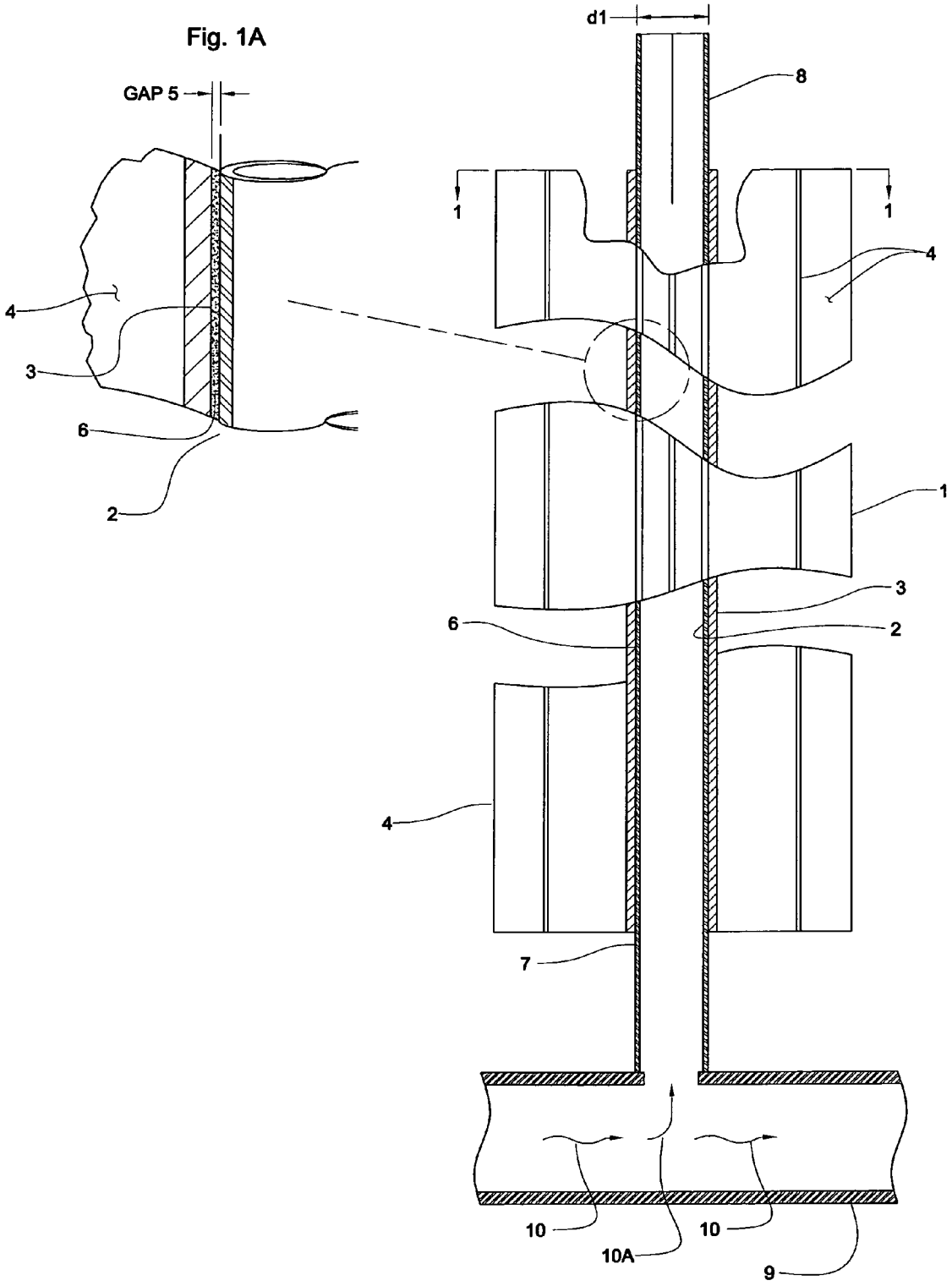
FIG. 1 is a side elevational view partially broken away of the cryogenic fluid vaporizer heat exchange element in accordance with the present invention.
Figures 2, 2A:
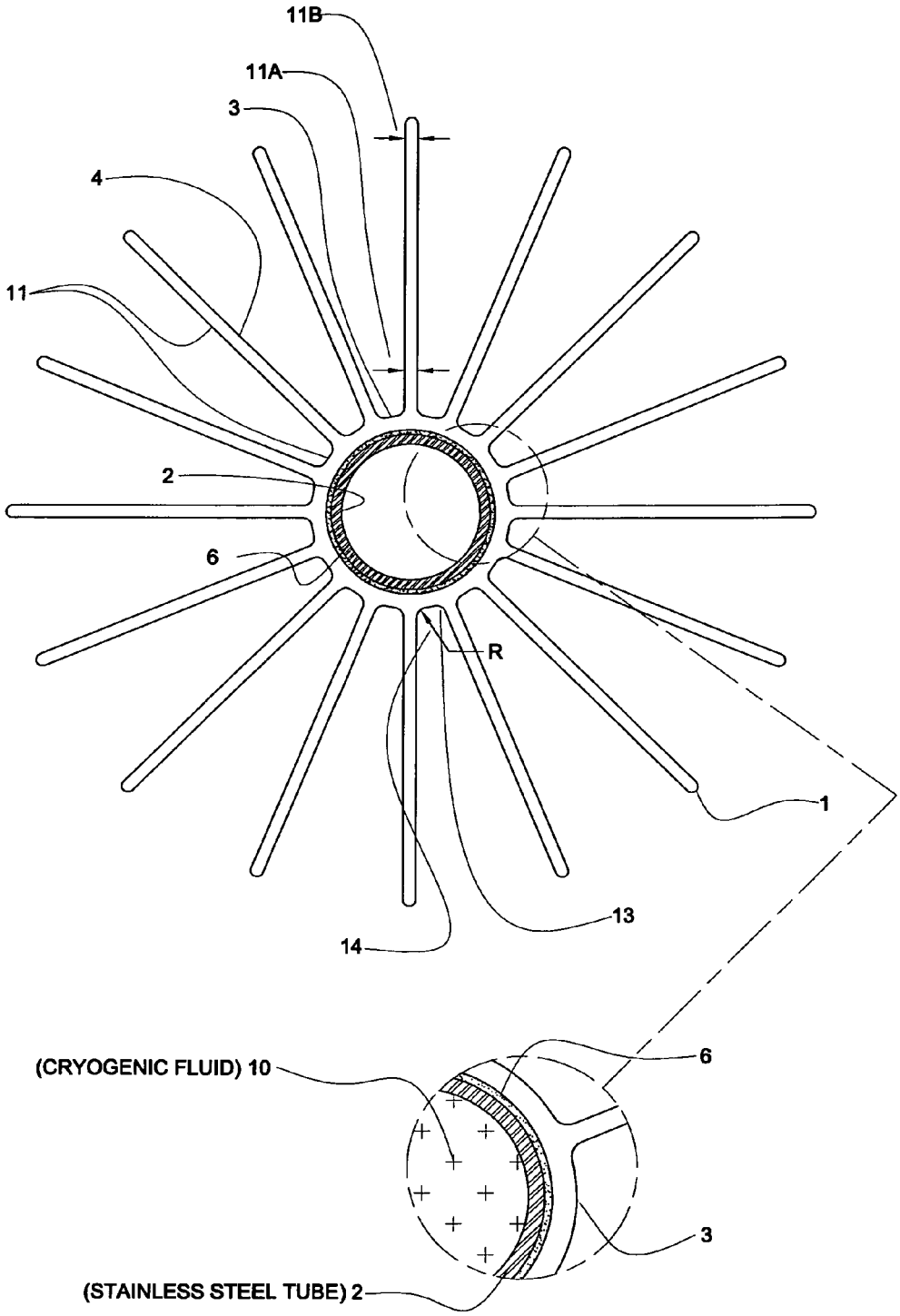
FIG. 2 is a cross-sectional view of the heat exchange element taken along Lines 1-1 of FIG. 1.
FIG. 2A is an enlarged detailed view of the circled portion of FIG. 2.

In FIG. 1, there is shown a side elevational view partially broken away of the cryogenic fluid ambient atmospheric air vaporizer heat exchange element of the present invention. FIG. 2 is a cross sectional view of the heat exchange element of FIG. 1 taken along the Lines 1-1 of FIG. 1. The particular vaporizer heat exchange element 1 (FIG. 1) comprises a central austenitic stainless steel tube 2 contained within a central tubular hub 3 with fins 4, said hub with fins being formed of extruded aluminum. The central tube 2 extends the full length of central hub 3 including extended portions 7 and 8 at each end of central hub 3. The central stainless steel tube 2 has an outside diameter D1 of from about 0.25 inch to about 1.0 inch and preferably about 0.5 inch and being of sufficient thickness to contain the cryogenic fluid supply pressure commonly about 0.049 inch thick to about 0.083 inches thick. The central tubular aluminum hub 3 into which the stainless steel tube 2 is fully inserted has a particular inside diameter greater than the outside diameter of tube 2 in order to form a gap 5 (FIG. 1A) between the outside surface of tube 2 and the inside surface of hub 3. This gap 5 (FIG. 1A) may vary between about 0.005 inch and 0.05 inch preferably about 0.015 inch and is filled with thermal barrier material 6, said thermal barrier material having a thermal conductivity of between about 0.02 BTU/(HR) (FT) (Deg F.) (where BTU is a British thermal unit, HR is hour, FT is feet and Deg F. is degrees Fahrenheit) and 0.07 BTU/(HR) (FT) (Deg F.), preferably about 0.05 BTU/(HR) (FT) (Deg F.). A wide range of thermal barrier material is available such as polyurethane foam sold under the name Stephan Foam 3X250A available from Stephan Chemical Company or alternatively polyimide foam sold under the name Solimide TA-301 available from Evonik Industries.

Ambient air cryogenic vaporizers generally are comprised of a multiplicity of the heat exchange elements 1 of FIG. 1 and are interconnected using manifolds or headers 9 such that the cryogenic fluid 10 is distributed in equal portions 10A to the multiplicity of elements 1.

In FIG. 2 is shown a cross-sectional view of the heat exchange element 1, taken along Lines 1-1 of FIG. 1. In this preferred embodiment, aluminum extrusion 11 is comprised of central tubular hub section 3 and a multiplicity of axial fins 4 which extend axially along the full length of extrusion 11 with such extrusion lengths being between four and forty feet. The fins 4 may number between about eight and twenty fins extending radially outward a distance of between about 2½ inches and 4 inches from central hub 3. Fins 4 are between about 0.055 inch thick and 0.08 inch thick and may vary in thickness as they radiate outward from hub 3 with the thicker portion 11A (FIG. 2) at hub 3 and the thinnest portion 11B (FIG. 2) at the outer fin tip, and the tip may be rounded. Hub fins 4 are integral to central hub 3 and at the connection point 13 (FIG. 2) may be rounded via a filled radius 14 that is common to the extrusion process. More clearly shown in FIG. 2 is gap 5 (FIG. 1) formed between the outer surface of tube 2 and the inner surface of central tubular hub 3 with the gap being filled with thermal barrier material 6 as described above.

Figure 3:
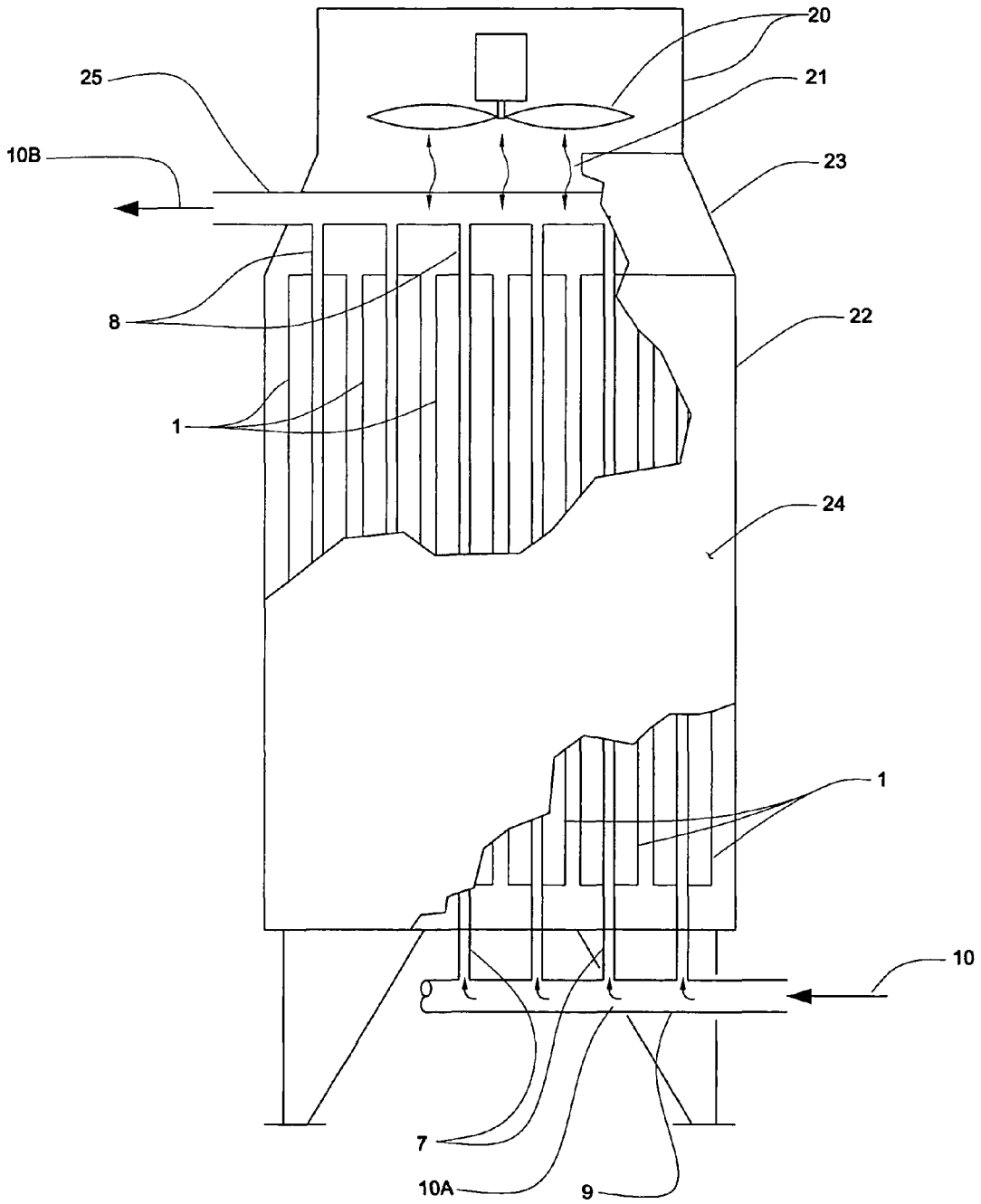
FIG. 3 is a side elevation view of a cryogenic fluid forced draft ambient atmospheric air vaporizer in accordance with the present invention.

In FIG. 3 there is shown a side elevation view partially broken array of a cryogenic fluid ambient atmospheric air vaporizer 24 which, as shown, employs forced air means. In this preferred embodiment, as shown in FIG. 3, forced draft air fan 20 is used to direct a stream of high velocity ambient atmospheric air 21 (FIG. 3) over a multiplicity of vaporizer heat exchange elements 1 (FIG. 1) said forced draft air stream 21 being forced in either axial direction over the exterior finned surfaces of vaporizer heat exchange elements 1, said air stream flowing in controlled fashion within outer duct 22 which also passes through forced draft air transition duct 23.

Cryogenic fluid 10 (FIG. 3) enters manifold or header 9 (FIG. 3) and is evenly distributed as equal fluid portions 10A (FIG. 3) to the multiplicity of heat exchange elements 1 (FIG. 3) at tube extended end portion 7 of heat exchange element central stainless steel tube 2 (FIG. 1). After being vaporized and superheated passing through stainless steel tube 2 (FIG. 1) of heat exchange elements 1 (FIG. 3), the cryogenic fluid 10 exits said elements at extended tube portions 8 (FIG. 3) and exits vaporizer 24 via exit manifold or header 25 (FIG. 3) as vaporized and super-heated fluid stream 10B (FIG. 3).

OPERATION OF APPARATUS

Referring to FIGS. 1-3, the operation of the forced draft ambient atmospheric air cryogenic fluid vaporizer having a multiplicity of heat exchange elements 1, are assembled together. The elements may number between 1 and about 150 and are enclosed within a forced air outer duct 22 (FIG. 3). A fan 20 (FIG. 3) is provided and attached to said duct 22 by means of transition duct 23. In operation, said fan provides a forced draft air stream 21 flowing evenly over the exterior finned surface area of said multiplicity of elements 1, said fan may force air stream 21 in either direction over elements 1. It is well known that the forced draft air stream may increase the heat transfer rate from the air to the element outer surface significantly over a natural draft vaporizer by as much as ten to twenty times. The heat exchange element 1 of this invention as described above has an exterior finned surface area exposed to the air between about 70 to 130 times the interior surface area of the central stainless steel tube 2 (FIG. 1), said interior surface area being exposed to cryogenic fluid 10A. In combination, the apparatus can deliver heat from the air to the cryogenic fluid by about 1000 times greater than that of a simple tubular element which has a surface area ratio of about 1.25/1 exposed to natural convection ambient air. Without incorporating the further modification of providing a gap 5 (FIG. 2A) and the gap being filled with thermal barrier material 6 as embodied in this invention, frost and ice would form on the exterior surface of the finned elements as is well described in the prior art. Such an undesirable frost or ice layer would clog the heat exchange surface exposed to the ambient air thus making it difficult to achieve a compact, continuously operating cryogenic ambient atmospheric air vaporizer.

Further difficulties are encountered when a frost or ice layer forms on the external surface of the heat exchange element that is exposed to the ambient atmosphere air, which difficulties are inherent in the physical properties of the frost or ice itself. It has been established by those skilled in the art that frost or ice density, such as measured in pounds per cubic feet, is not a constant but will actually vary widely depending upon how, when and at what temperature the frost or ice was formed. Further, it is known that the thermal conductivity of the frost also varies widely in a similar manner. Likewise, the amount of frost as measured by pounds per hour formed on the cryogenic surface exposed to the air varies significantly depending upon the surface temperature of the element surface exposed to the air and the water content (defined as relative humidity) of the air stream. For these reasons, the performance of prior art cryogenic fluid ambient atmospheric air vaporizers will vary widely making predictable performance difficult. For this added reason, the frost-free vaporizer of this invention that has predicable, continuous and steady state performance characteristics is a desirable addition to the prior art.

The cryogenic fluid 10 (FIGS. 1-3) enters manifold header 9 (FIGS. 1-3), is evenly distributed in fluid portions 10A, is vaporized and super-heated as it travels through central austenitic tubes 2 and exits said vaporizer 24 (FIG. 3) via exit manifold 25 as vaporized and super-heated cryogenic fluid 10B. With the introduction of thermal barrier material 6 (FIGS. 1-2) to fill gap 5 (FIGS. 1-2), a temperature drop occurs as heat passes from the ambient air through said gap to the cryogenic fluid. Since this insulating barrier gap is at the hub location 3 (FIGS. 1-2) rather than as frost for example, on the external surface of fins 4 (FIGS. 1-2) as, for example, in Vogler, Jr. described above, the significant advantages of the area ratio of between 70 and 130 of this invention combined with the controlled and known low thermal conductivity of said thermal barrier material now make possible a defined, controllable and significant temperature drop from the ambient air to the cryogenic fluid thereby permitting a frost-free ambient atmospheric air cryogenic fluid vaporizer not shown or described in the prior art.

EXAMPLE

Ambient air vaporizer heat exchange elements of prior art vaporizers without the thermal barrier of this instant invention were compared with the elements of FIG. 1 of this invention in a full-scale forced draft ambient air single element vaporizer apparatus essentially as configured in FIG. 3 above. Cryogenic liquid nitrogen at a temperature of about −300° F. was used as the representative cryogenic fluid 10 (FIG. 1). The central extruded aluminum tubular hub 3 (FIG. 1) was sized for a ½ inch outer diameter austenitic stainless steel tube 2 (FIG. 1). The hub fins 4 (FIG. 1) extended about 3⅝ inches radially outward. A forced draft air fan 20 (FIG. 3), an outer duct 22 (FIG. 3) and a transition duct 23 (FIG. 3) completed the model vaporizer 24 (FIG. 3).

For a test of prior art, a stainless steel tube 2 (FIG. 1) was hydro expanded into hub 3 (FIG. 1) to achieve a no gap intimate contact between the inside surface of the central aluminum hub and the outside surface area of the central austenitic stainless steel tube as is standard practice in prior art elements.

In this prior art test, the extruded aluminum hub had twelve fins, which number of fins provides a space between fins for frost growth. When tested with 78° F. entering air from fan 20 (FIG. 3) and using liquid nitrogen entering tube 2 (FIG. 1) at about −300° F.:

1) the frost thickness grew to about 0.4 inches thick on the outside surface of the hub fins 4 (FIGS. 1-2) after 1½ hours of operation;
2) the pressure drop of the forced draft air passing through the outer duct 22 (FIG. 3) increased from 0.5 IN W.C. (inches of water column) at the start, i.e. with no frost on the element to 0.9 IN W.C., after 1½ hours of operation; and
3) the nitrogen gas outlet temperature at location 10B (FIG. 3) decreased from about 70° F. at the start to about 61° F. after 1½ hours of operation.

This foregoing test confirmed that the vaporizer was building frost and was not operating in a steady state condition at any time and that a shutdown would be required for defrost.

To test a similar vaporizer element provided with the gap 5 and thermal barrier 6 (FIGS. 1-2) of this invention, a similarly dimensioned aluminum extrusion was used in the apparatus, said aluminum extrusion had sixteen fins 4 (FIG. 2) and the stainless steel liner tube 2 (FIG. 1) had a gap 5 (FIG. 1) between the stainless tube 2 and the aluminum tubular hub inside diameter of 0.012 inches and the gap 5 was filled with a thermal barrier material 6 (FIG. 1) of this invention. When tested using cryogenic liquid nitrogen entering at about −300° F. on 80° F. entering air from fan 20 (FIG. 3), no frost or ice formed on the exterior surface or fins 4 of extrusion 3 (FIG. 1). This test was run for about 1 hour under stable operating conditions of 0.9 IN W.C. air duct pressure drop with a constant 78° exit nitrogen gas temperature. The aluminum surface temperature at the outside of the hub measured 32° F., with no water freezing on the surface. The stable operating condition while producing a frost-free vaporizer indicated that since operating conditions were stable, the vaporizer could continue to operate without shutdown for defrost and with a constant exit nitrogen gas temperature.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

DRAWING REFERENCE NUMERALS WORKSHEET

1. Vaporizer heat exchange element
2. Central austenitic stainless steel tube
3. Central aluminum tubular hub
4. Hub fins
5. Gap between tube 2 and hub 3
6. Thermal barrier material
7. Extended end portion of tube 2
8. Extended end portion of tube 2
9. Manifold or header
10. Cryogenic fluid
10A. Cryogenic fluid equal portion
10B. Vaporized and superheated cryogenic fluid
11. Aluminum extrusion
11A. Hub fin 4 thickness at hub
11B. Hub fin 4 thickness at tip
13. Hub fin 4 connection point to hub 3
14. Extrusion fillet radius at hub 4
20. Forced draft air fan
21. High velocity ambient atmospheric air stream
22. Forced draft air outer duct
23. Forced draft air transition duct
24. Forced draft atmospheric ambient air cryogenic fluid vaporizer
25. Exit manifold or header

DEFINITIONS

For the purposes of this invention, certain terms used herein are defined as:

1. An ambient atmospheric air cryogenic vaporizer of the invention uses only air directly from the surrounding atmosphere at varying natural ambient temperatures and at the prevailing relative humidity, such air flows over and in direct contact with the exterior surface of the heat exchange elements by either the natural convection heat transfer process, or with the addition of an air moving fan to provide a forced draft or forced air convection heat transfer process. No additional or supplementary energy other than the fan, if used, is required.
2. Continuous vaporization means that the vaporization process may be operated for any desired length of time without shut down or interruption of the process, said vaporization process providing an outlet gas exit temperature which is stable at the given design condition of the apparatus, i.e., a steady state heat exchanger.
3. Cryogenic fluid is any gas, liquid or supercritical fluid having an inlet temperature to the apparatus that is below −100° F.
4. "LNG" means liquefied natural gas commonly used in gaseous form as fuel or fuel gas.

5. Heat source—any medium such as air, water, steam, hot combustion gas, etc. which provides heat to vaporize and/or superheat cryogenic fluid.
6. Indirect heat transfer loop—a closed or open fluid circuit, which may be pumped, of air, water, antifreeze liquid, used to provide the means to utilize various heat sources.
7. Frost/Ice free operation means that when ambient air is used as the heat source and in direct contact with the outside surface of the ambient vaporizer, the moisture (water) in the ambient air does not freeze or precipitate onto the surface of the vaporizer element which is exposed to the air.
8. Thermal conductivity—a material property relating to the ability of a material to transfer heat through the material, commonly expressed as BTU/(HR) (FT) (Deg F.)
   Where
   BTU=British thermal unit
   HR=Hour
   FT=Foot of length
   Deg F.=Temperature expressed as degree Fahrenheit
9. Area ratio is defined as the heat exchange element outside surface area per foot of length exposed to the ambient air divided by the internal surface area of the cryogenic fluid central tube per foot of length exposed to the cryogenic liquid which ratio is dimensionless.
10. Thermal barrier is defined as a resistance to the flow of heat through the material, thusly being the reciprocal of thermal conductivity of the material. If such a barrier thickness of a certain material is increased by for example, two times, the thermal resistance to the flow of heat would be about two times that of the original thickness.
11. Periodic shutdown due to ice buildup means that the ambient air cryogenic vaporizer is required to have the flow of cryogenic fluid stopped or interrupted so as to allow snow or ice to be removed since such snow or ice would cause non-performance of the vaporizer.

What is claimed is:

1. An apparatus for continuously vaporizing a cryogenic fluid by employing only heat absorbed from the ambient atmospheric air and without requiring periodic shutdown due to ice buildup and having at least one vaporizing heat exchange element, said element being comprised of:

a central tube of metal suitable for cryogenic temperatures such as austenitic stainless steel, aluminum, monel and copper, a central extruded aluminum externally finned tubular hub, said central metal tube fully inserted into said central tubular hub with the internal diameter of said tubular hub being greater than the outside diameter of said metal tube, wherein the difference in said internal and external diameters creates a uniform uninterrupted gap, said gap being filled with a thermal barrier material layer of low thermal conductivity and of defined thickness.

2. The vaporizing heat exchange element of claim 1, wherein said apparatus operates without the formation of frost or ice on the outer surface of said central extruded aluminum externally finned tubular hub.

3. The apparatus of claim 1, wherein said central metal tube has an outside diameter within the range of between 0.25 inch and 1.0 inch.

4. The apparatus of claim 2, wherein said internal diameter of said central aluminum tubular hub is sufficiently greater than said outer diameter of said central metal tube wherein said gap is within the range of 0.005 inch and 0.05 inch and wherein said thermal barrier material has a thermal conductivity within the range between 0.02 BTU/(HR) (FT) (Deg F.) and 0.07 BTU/(HR) (FT) (Deg F.).

5. The apparatus of claim 1, wherein said thermal barrier material is polyurethane foam or polyimide foam.

6. The apparatus of claim 1, wherein said central extruded aluminum finned tube has between 8 and 20 external fins extending radially outward from the central hub within the range between 2½ inches to 4 inches.

7. The apparatus of claim 1, where said element has a length within the range of between 4 and 40 feet.

8. The apparatus of claim 1, wherein said element has a surface area ratio of external finned surface area of said tubular hub divided by the internal surface area of said central metal tube within the range between 70 and 130.

9. The apparatus of claim 1, wherein said apparatus further incorporates a forced draft air fan and a forced draft air outer duct.

10. The apparatus of claim 1, wherein said apparatus is comprised of two or more of said vaporizer heat exchange elements wherein said elements are interconnected by means of an inlet manifold and an outlet manifold.

* * * * *